US008991002B2

(12) United States Patent
Tiekoetter et al.

(10) Patent No.: US 8,991,002 B2
(45) Date of Patent: Mar. 31, 2015

(54) BAGLESS VACUUM CLEANER WITH A DUST COLLECTOR

(71) Applicant: Miele & Cie. KG, Guetersloh (DE)

(72) Inventors: Stefan Tiekoetter, Bielefeld (DE); David Buhl, Bielefeld (DE); Klemens Andrup, Verl (DE); Michael Agethen, Vlotho (DE)

(73) Assignee: Miele & Cie. KG, Guetersloh (DE)

( * ) Notice: Subject to any disclaimer, the term of this patent is extended or adjusted under 35 U.S.C. 154(b) by 94 days.

(21) Appl. No.: 13/858,138

(22) Filed: Apr. 8, 2013

(65) Prior Publication Data

US 2014/0298610 A1 Oct. 9, 2014

(51) Int. Cl.

| | |
|---|---|
| ***A47L 9/10*** | (2006.01) |
| ***A47L 9/19*** | (2006.01) |
| ***A47L 9/16*** | (2006.01) |
| ***A47L 9/28*** | (2006.01) |

(52) U.S. Cl.

CPC ..... *A47L 9/19* (2013.01); *A47L 9/1683* (2013.01); *A47L 9/2836* (2013.01); *A47L 9/2857* (2013.01)

USPC ..... 15/347

(58) Field of Classification Search

CPC ..... A47L 9/1683
USPC ..... 15/347
IPC ..... A47L 9/10, 9/16
See application file for complete search history.

(56) References Cited

U.S. PATENT DOCUMENTS

2014/0196244 A1* 7/2014 Moshenrose ..... 15/324

* cited by examiner

*Primary Examiner* — David Redding
(74) *Attorney, Agent, or Firm* — Leydig, Voit & Mayer, Ltd.

(57) ABSTRACT

A bagless vacuum cleaner includes a dust container including a chromogenic material so as to have a controllable transparency.

11 Claims, 6 Drawing Sheets

BAGLESS VACUUM CLEANER WITH A DUST COLLECTOR

CROSS REFERENCE TO RELATED APPLICATIONS

1. Field

The present invention relates to a bagless vacuum cleaner having a dust container.

2. Background

Bagless vacuum cleaners are per se known. Such vacuum cleaners operate with a centrifugal separator. The outer housing of such a centrifugal separator, sometimes also called "cyclone", functions as a dust container in the bagless vacuum cleaner. A large portion of the picked-up dust is collected in this dust container. However, during operation, the inside surfaces of the dust container become contaminated, in particular, by deposition of fine dust thereon.

Therefore, there is still room for improvement for such bagless vacuum cleaners, because a transparent dust container may develop an unhygienic appearance in the course of its use due to picked-up dust, in particular fine dust, when dust deposits form on the inner surfaces of the dust container. Conversely, the dust container cannot be non-transparent because if it were, the user would no longer be able to easily visually check the filling level.

British Patent Publication GB 2 441 174 A describes a vacuum cleaner whose dust container is partially reflective and partially transparent to prevent permanent visibility of the dust contained in the dust container, and to prevent an unfavorable visual appearance associated therewith. The dust container is intended to be reflective, and thus non-transparent, when viewed from the outside under normal light conditions. To be able to monitor the vacuuming process and the filling level, an illumination means is activated during vacuuming to illuminate the interior of the dust container, so that the interior can be viewed from the outside.

While in GB 2 441 174 A, the interior of the dust container is intended to be illuminated by light sources which are disposed in the vacuum cleaner housing and directed toward the dust container, German Patent Publication DE 10 2007 011 457 A describes a special embodiment for illuminating the interior of the dust container, namely an electroluminescent material from which a rear portion of the dust container is completely or partially made from or with which the rear portion of the dust container is completely or partially coated.

German Utility Patent DE 20 2010 006 456 U describes a robotic vacuum cleaner as an example of an appliance that has a housing which emits light in an environment-dependent color. To this end, the robotic vacuum cleaner is provided with a housing which is at least partially optically transmissive and transparent, so that light coupled into the transmissive part propagates therein and is visible when viewing the exterior surface.

U.S. Pat. No. 5,589,958 describes the use of electrochromic material for front elements of built-in kitchens. In accordance with the approach described there, the interior of a kitchen cabinet or a refrigerator may be viewed without opening its door by suitably controlling the electrochromic material. Similarly, German Patent DE 10 2005 027 572 B describes a dishwasher having glass surfaces whose optical properties are switchable to make control elements visible as needed. To this end, the dishwasher has an outer transparent glass layer and, beneath the same, a switchable glass layer having in particular electrochromic properties, under which, in turn, is provided an inner glass layer. Control elements mounted on the rear face of the inner glass layer become visible only when the switchable glass layer is controlled correspondingly. This allows control elements of the dishwasher to be made visible exactly when, based on a signal receivable from, for example, a proximity switch, it may be assumed that a user wishes to input control commands to the dishwasher.

SUMMARY

In an embodiment, the present invention provides a bagless vacuum cleaner including a dust container including a chromogenic material so as to have a controllable transparency.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
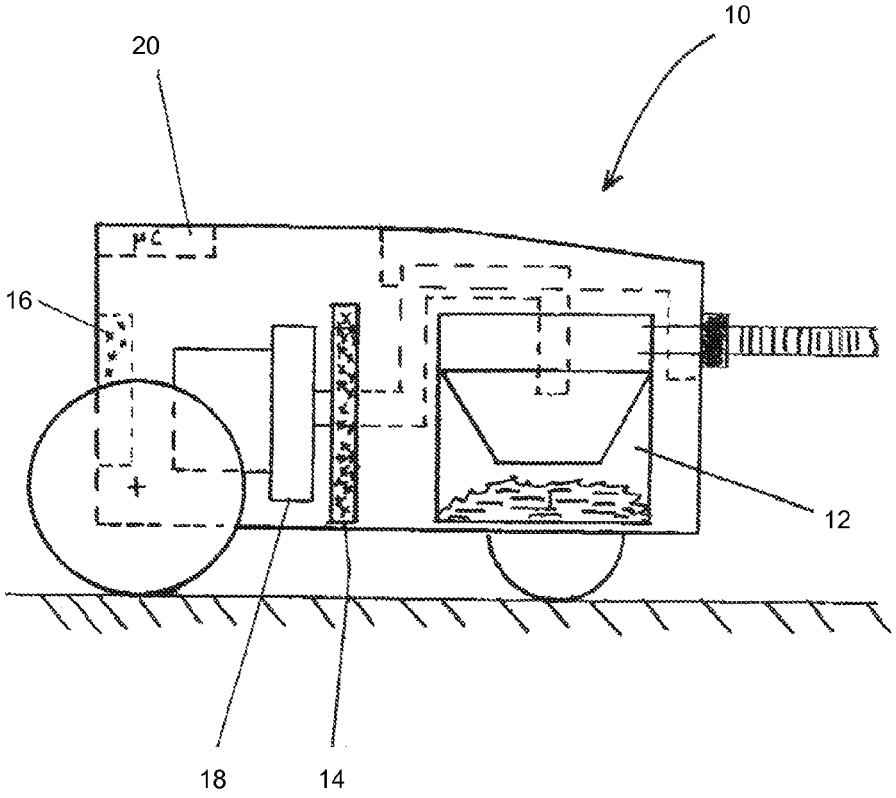
Figure 1 (prior art)
FIG. 1 shows a prior art bagless vacuum cleaner.

It is an aspect of the present invention to provide a further embodiment of a vacuum cleaner which allows the contents of a dust container forming part of the vacuum cleaner to be made visible when needed.

In an embodiment, the present invention provides a bagless vacuum cleaner including a dust container, in particular a bagless vacuum cleaner including a dust container, an intermediate filter, an exhaust filter, a suction fan, and a vacuum cleaner control system, provision is made for the dust container to be completely or partially made from a chromogenic material or be coated with such a material, so that it is controllable in its transparency. The expression "controllable in its transparency" as used above and below means that the material itself changes its optical properties in a controlled manner between transparent or substantially transparent and non-transparent or substantially non-transparent.

Because the dust container is controllable in its transparency due to its material properties, the user is still be able to visually check the filling level when the dust container or portions thereof is/are in a transparent state. In a non-transparent state, dust deposits on the interior surfaces of the dust container are not disturbing, and an otherwise unhygienic appearance of the dust container or vacuum cleaner is avoided.

One material that may be used for the dust container or for coating the dust container is a chromogenic functional polymer. Chromogenic material is to be carefully distinguished from luminescent material and the electroluminescence effect (which forms the basis of the approach described in DE 10 2007 011 457 A). A special form of chromogenic material is electrochromic material. The transparency; i.e., the light transmission, of an electrochromic material changes upon application of an electric voltage. In the case of electroluminescence, application of an electric voltage causes the emission of light. In comparison with conventional light sources, the use of the electroluminescence effect is just an alternative way to illuminate the interior of a dust container, but does not produce any change in the transparency of the dust container due to its material properties.

In the approach proposed here, the material properties of the dust container are themselves used for controlling its transparency. This is achieved through the use of chromogenic, in particular electrochromic, material. This is also to be carefully distinguished from a change in the ability to see into a space, such as, for example, a dust container, when its interior is brighter than the surroundings of the viewer. The latter effect, on which the approach in GB 2 441 174 A is based, is generally known and can be observed in living spaces as well as in store windows or the like. The visual perceptibility of an interface defining a particular space being viewed, such as a window pane, or here the wall of a dust container, decreases with the brightness of the interior of such a space. However, unlike when using chromogenic, in particular electrochromic, material as described herein, the optical properties of the interface are not changed in the process.

In accordance with the approach proposed here, controllability of the transparency of the dust container can be achieved by making the dust container from a chromogenic material, in particular a chromogenic functional polymer, either entirely or in portions which then act as a window or the like. Alternatively, the dust container may be manufactured, for example, from a plastic. In this case, transparent regions are formed at least in portions of the dust container. At least these transparent regions may also be coated with a chromogenic material, in particular a chromogenic functional polymer, for example, by permanently applying such a coating or by applying it in the form of an adhesive film or the like. All of the variants described, and also those which are apparent to one skilled in the art from the embodiments presented herein, will be referred to below as "controllability of the transparency of the dust container" without loss of generality and irrespective of whether this is achieved for the entire dust container or only portions thereof, and of whether this is achieved by controlling the material from which the dust container is made or by controlling a coating applied to an inner or outer surface of the dust container.

In a specific embodiment of the bagless vacuum cleaner, the chromogenic material is an electrochromic material, and the dust container has electrodes for activating the electrochromic material. Electrochromic material has the advantage that its transparency can be controlled by a current flow and/or an external electromagnetic field. This allows the transparency of the dust container to be controlled in a particularly simple and unproblematic manner.

In another embodiment of the bagless vacuum cleaner, the dust container is removable from the vacuum cleaner, and the electrodes associated with the dust container are connectable with an electric circuit for activating the electrochromic material during the combining of the dust container with the vacuum cleaner. In this embodiment, the dust container remains removable from the vacuum cleaner for cleaning purposes or the like. When, for example, after cleaning of the dust container, the dust container is reinserted into (i.e., combined with) the vacuum cleaner; the electrodes associated with the dust container are thereby automatically connected with an electric circuit for activating the electrochromic material, which eliminates the need for the user to take care himself or herself that the electrodes are connected and the electric circuit for activating the electrochromic material is operational. A dust container for a bagless vacuum cleaner is typically positively received or locked in the vacuum cleaner in order to prevent dust from escaping during use and to allow the suction power to be obtained. This results in defined positions for the dust container with respect to the surrounding interior of the vacuum cleaner. These defined positions may be used to provide contact points on an exterior surface of the vacuum cleaner for the contacting of the electrodes. During the combining of the dust container with the vacuum cleaner, such contact points can be easily contacted with corresponding contact elements, such as spring contacts or the like, which are associated with the interior of the vacuum cleaner.

In a specific embodiment of the bagless vacuum cleaner, the electric circuit for activating the electrochromic material is controllable via a control element of the vacuum cleaner. The user can then select whether the vacuum cleaner should be transparent or non-transparent. One particular location for such a control element for controlling the transparency of the dust container may be a user control on a handle of the vacuum cleaner, especially if the bagless vacuum cleaner is in the form of a so-called stick vacuum cleaner, a canister vacuum cleaner, or a hand vacuum cleaner.

If the user control includes a switch as a control element for controlling the electric circuit for activating the electrochromic material, a transparent state and a non-transparent state of the electrochromic material are associated with the two positions of such a switch. This allows the user to easily select and change the state of the dust container. As an alternative to a switch, it is also possible to provide a momentary push button or the like. With respect to the operation of a momentary push button, provision may be made for the electrochromic material to be activated only as long as the momentary push button is pressed in order to make the dust container transparent. In one specific embodiment, it may suffice to briefly press the momentary push button, and the electrochromic material may be automatically activated for a predetermined or predeterminable period of time in order to make the dust container transparent.

In another embodiment of the bagless vacuum cleaner, the electrochromic material may be automatically activated at predetermined or predeterminable points in time, in particular at predetermined or predeterminable points in time for a predetermined or predeterminable period of time. The point in time for activating the electrochromic material in order to make the dust container transparent can be, for example, the time at which the vacuum cleaner is switched on, because this is when it is occasionally necessary to check whether the intended vacuuming operation can still be performed or whether the dust container previously needs to be emptied. The time at which the vacuum cleaner is switched off may alternatively or additionally be used as a point in time for such an activation of the electrochromic material, because it may be useful to empty the dust container after the use of the vacuum cleaner, if indicated by the filling level of the dust container. Additionally or alternatively, the electrochromic material may also be activated automatically during the operation of the bagless vacuum cleaner, for example, at equally spaced points in time, so that the user is able to assess the vacuuming results based on the change in the filling level of the dust container.

The approach described here and below may in principle be used for any type of vacuum cleaner; i.e., for canister vacuum cleaners, stick vacuum cleaners, hand vacuum cleaners, etc. In hand vacuum cleaners, in particular, complex measurement methods for assessing the filling level of the dust container mostly have to be dispensed with for reasons of space and/or cost, and therefore the ability to visually check the filling level is particularly relevant here. However, such vacuum cleaners are kept, inter alia, in living spaces, such as the kitchen, living room or dining room, so that permanent visibility of the picked-up dirt may be particularly disturbing. Therefore, the approach proposed here is especially suitable for use in such vacuum cleaners, although it is not limited thereto.

An exemplary embodiment of the present invention is shown in the drawings in a purely schematic way and will be described in more detail below. Corresponding objects or elements are identified by the same reference numerals in all figures. It is understood that neither this nor any other exemplary embodiment should be construed as limiting the scope of the present invention. Rather, within the framework of the present disclosure, changes and modifications are possible, which, for example, by combining or altering individual features or method steps described in connection with the general or detailed description, as well as the claims, and/or shown in the drawings, may be inferred by one skilled in the art with regard to achieving the objective, and lead, through combinable features, to a new subject matter or to new method steps or sequences of method steps.

FIG. 1 shows a canister-type bagless vacuum cleaner 10 known in the art. This vacuum cleaner has a centrifugal separator (dust container 12), which is sometimes also referred to as a cyclone 12 in the terminology of the field. An intermediate filter 14 (fine dust filter) and an exhaust filter 16 are arranged downstream of the centrifugal separator in the direction of the suction air stream arising during operation. A fan 18 is provided in known manner for producing the suction air stream. A vacuum cleaner control system 20 is provided for controlling bagless vacuum cleaner 10. This control system includes, for example, a microcontroller and a memory. The user can control the operating mode of bagless vacuum cleaner 10 by making settings on a user control or the like (FIG. 3), the settings being interpreted by vacuum cleaner control system 20 and used, for example, to control the speed of fan 18, and thus the suction power.

In bagless vacuum cleaners 10 known in the art, the entire dust container 12, or a major portion thereof, is made from a transparent polymer, on the one hand, to allow the user to look into dust container 12 and, on the other hand, to visualize the operation of the cyclone, and specifically the cyclone vortex which forms in dust container 12 and sets the picked-up dust into rotation. Some bagless vacuum cleaners 10 use dust containers 12 made of a non-transparent polymer.

Figure 2:
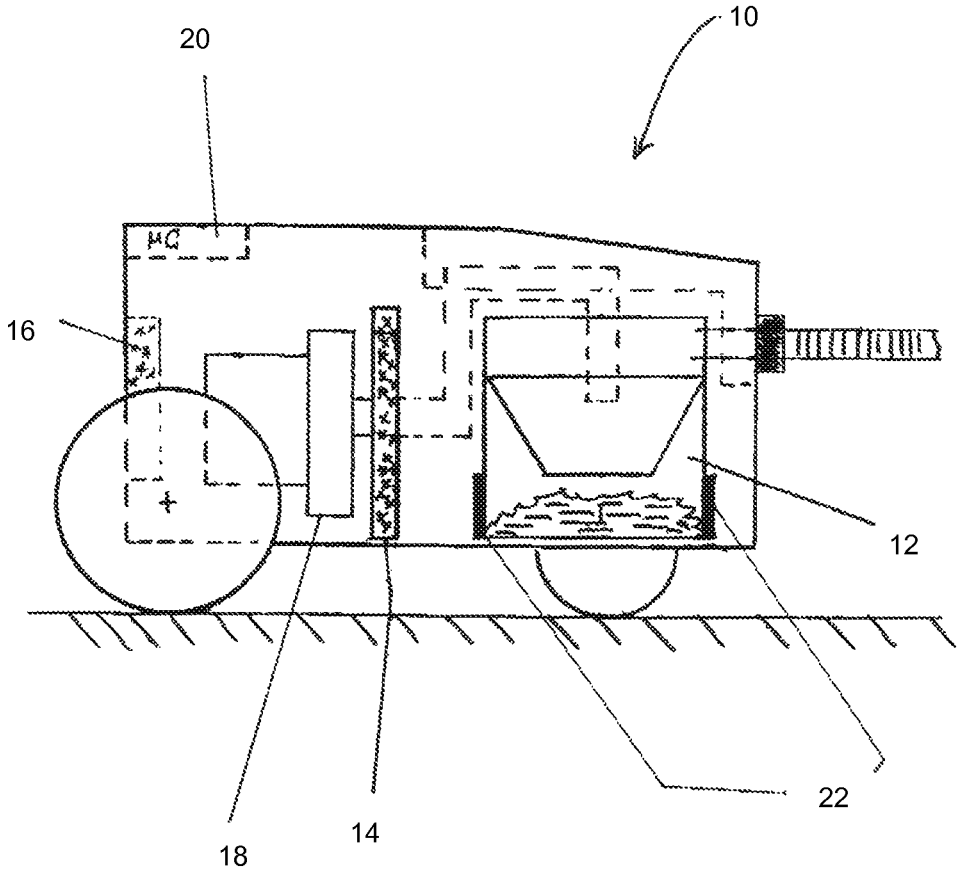
FIG. 2 shows a bagless vacuum cleaner according to FIG. 1, having a dust container that is controllable in its transparency.

FIG. 2 shows an embodiment of a bagless vacuum cleaner 10 according to the present invention. Although this cannot be seen from FIG. 2, dust container 12 is completely or partially made from a chromogenic functional polymer, here an electrochromic material, or coated with such a material, which allows dust container 12 to be controlled in its transparency. This makes it possible to achieve variable optical properties, especially variable transparency or also color changes, and thus controllability of the transparency.

The chromogenic material from which dust container 12 is made is here assumed to be electrochromic material. Dust container 12 has electrodes 22 associated therewith which are effective for activating the electrochromic material from which dust container 12 is completely or partially made, or with which dust container 12 is completely or partially coated. Electrodes 22 form part of an electric circuit which originates at vacuum cleaner control system 20 or is at least controllable by vacuum cleaner control system 20, and are thereby operatively connected to vacuum cleaner control system 20. Materials that may be used as the electrochromic material include, in particular, electrochromic polymers whose transparency can be changed by applying an electric field/an electric voltage, such as will develop between two spaced-apart electrodes 22, as shown in FIG. 2. The electric field or voltage between electrodes 22 can be switched by vacuum cleaner control system 20 such that electrodes 22 and the electric circuit in which they are integrated are effective for controlling the transparency of dust container 12.

Figure 3:
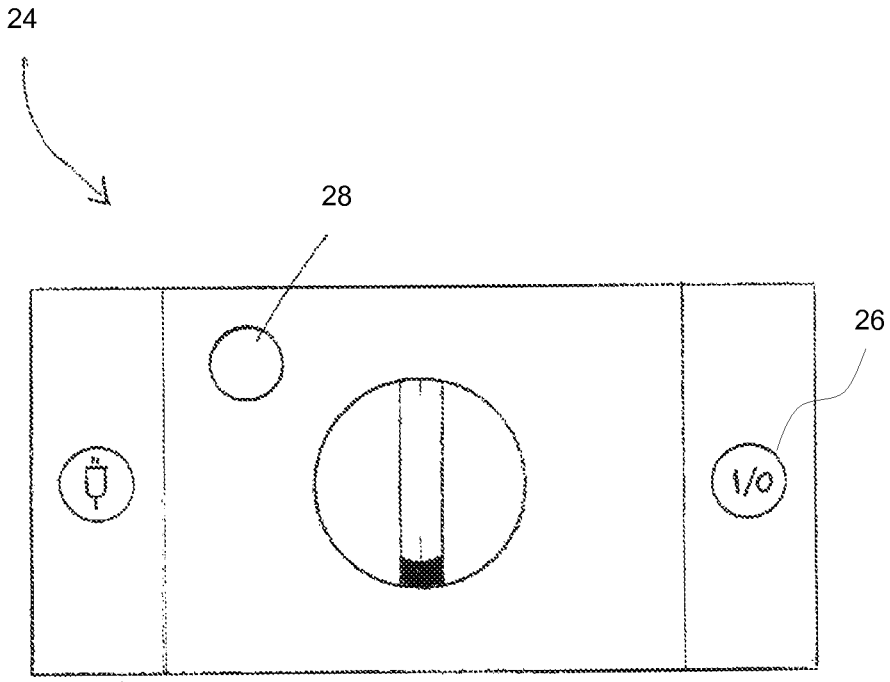
FIG. 3 shows a user control for a vacuum cleaner according to FIG. 2.

FIG. 3 shows a user control 24 provided for acting on vacuum cleaner control system 20. The user control includes (from left to right) generally known control elements for activating a cord retractor, for setting the suction power, and for turning vacuum cleaner 10 on and off (ON/OFF switch 26) and, in addition, also a control element 28 which can be used to control the transparency of dust container 12 and may be in the form of a momentary push button or a two-position push button switch. When control element 28 is operated, the above-mentioned electric circuit is closed or a means for closing this electric circuit is activated, so that an electric field develops between electrodes 22 or an existing electric field is turned off.

If control element 28 is in the form of a momentary push button, actuation thereof may start a time counter which turns off the electric field/the electric voltage when it expires; i.e., after a defined period of time has elapsed, so as to restore dust container 12 to the non-transparent state. Thus, it is only during a short period of time than one can look into dust container 12, for example, to check the filling level/load condition. If control element 28 is in the form of a switch, the user is provided with an easy way to decide whether dust container 12 is to be switched and maintained in the transparent state or in the non-transparent state. It is thus up to the user to select a particular state of transparency. This variant can also be combined with the expiration of a time counter or a period of time that is suitably defined otherwise, so that, for example, each time the position of a switch that functions as control element 28 is changed, dust container 12 is switched to the transparent state during the expiration of the respective suitably defined period of time.

It is also possible for the electric field to be applied to dust container 12 via electrodes 22 immediately, in particular only immediately, after bagless vacuum cleaner 10 is turned on, and to be turned off when a defined period of time of, for example, two minutes, has elapsed. This allows the user to check the filling level/load condition of dust container 12 immediately after bagless vacuum cleaner 10 is turned on. Alternatively or additionally to being positioned in or on a user control 24, which is usually mounted on the exterior of the housing of bagless vacuum cleaner 10, the control element 28 shown in FIG. 3 may also be disposed on a handle or the like, for example, a handle member of a suction hose if bagless vacuum cleaner 10 is embodied as a canister vacuum cleaner. In this case, control element 28 functions, as it were, as a remote control for controlling the transparency of dust container 12.

In a specific embodiment of the bagless vacuum cleaner of FIG. 2, the vacuum cleaner includes one or more light sources which are associated with dust container 12 and activatable synchronously with the controlling of the transparency of dust container 12. The or each such light source (e.g. one or more LEDs because of the low power requirements) is located outside of dust container 12 and illuminates the same during the transparent phase. This allows the user to optimally view the interior of dust container 12. This will be explained further below in connection with further details for a bagless vacuum cleaner 10 embodied as a hand vacuum cleaner.

The transparency of dust container 12 can be controlled continuously, or at least substantially continuously, namely in different levels of transparency, by vacuum cleaner control system 20 by means of a variable electric field/a variable electric voltage. The level of transparency may be controlled, for example, as a function of the filling level such that, for example, a high filling level is associated with complete transparency. The fill level sensor used may be, for example, an optical level sensor disposed in dust container 12.

Figure 4:
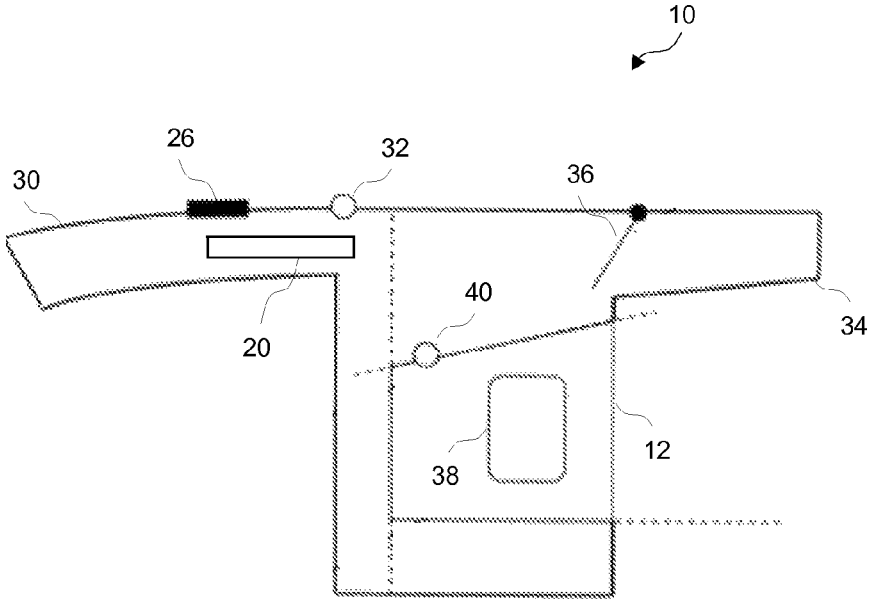
FIG. 4 shows a bagless vacuum cleaner in the form of a hand vacuum cleaner having a dust container that is controllable in its transparency.

FIG. 4 shows, in simplified schematic form, a vacuum cleaner 10 configured as a hand vacuum cleaner. Vacuum cleaner 10 includes a dust container 12, which is detachable from the remainder of the housing of vacuum cleaner 10, a handle 30, an ON/OFF switch 26, a charge/operating state indicator 32, a suction opening 34, and a dust check valve 36 disposed between suction opening 34 and dust container 12 in the direction of the suction air stream.

Dust container 12 is for the most part visually opaque and includes at least one viewing window that is controllable in its transparency. Viewing window 38 is here located on a side of vacuum cleaner 10, but may also be located in any other position which allows the user to view the interior of dust container 12 as conveniently as possible. A similar viewing window 38 may also be located on the other side of dust container 12; i.e., the side facing into the plane of the drawing. The shape of viewing window 38 is by no means limited to the shape shown here. Rather, viewing window 38 may be configured in any desired shape. Similarly, the relative size of viewing window 38 with respect to dust container 12 is not limited to the size shown here. Viewing window 38 may, for example, also be a viewing window that extends continuously from one side of dust container 12 to the other. Dust container 12 may also be made entirely from a material that is controllable in its transparency. A dust container 12 of this type and a dust container 12 having such a viewing window 38 are also examples of a dust container 12 that is completely or partially made from or coated with a chromogenic material. The electrochromic material, which can switch its optical properties, for example, from a transparent state to a nontransparent state, in response to the application of an electric field or an electric current, makes viewing window 38 controllable in its transparency. This makes it possible to view the interior of dust container 12; i.e., to visualize the contents of dust container 12, at different points in time and/or in different conditions and/or upon user request.

In comparison to the embodiment of FIG. 2, the embodiment of vacuum cleaner 10 shown in FIG. 4 is distinctive primarily in that it is provided with at least one light source 40 (e.g., one or more LEDs) for illuminating an interior of dust container 12. Light source 40 allows the interior of dust container 12 to be illuminated to allow better viewing of its contents through viewing window 38, which is suitably controlled in its transparency for this purpose; i.e., switched to the transparent state. Thus, activation of light source 40 is always associated with controlling the transparency of dust container 12 in a suitable manner. Light source 40 may be activated, for example, continuously or at regular intervals during the vacuuming operation. To this end, vacuum cleaner 10 includes a vacuum cleaner control system 20 which is used to control light source 40 and the electrochromic material of viewing window 38. Light source 40 may be activated, for example, by ON/OFF switch 26 of vacuum cleaner 10 when vacuum cleaner 10 is turned on.

Light source 40 may be disposed outside of dust container 12 in the housing of vacuum cleaner 10. In this case, a transparent partition is provided between light source 40 and dust container 12, allowing the light source 40 to illuminate the interior of dust container 12 therethrough. Alternatively, light source 40 may be disposed in dust container 12. In this case, dust container 12 includes an electrical contact means allowing light source 40 to be electrically contacted to a contact point in the housing of vacuum cleaner 10, and thereby be connected to vacuum cleaner control system 20. The electrical contact means is preferably designed such that when dust container 12 is separated from the housing of vacuum cleaner 10, for example, to empty dust container 12, the electrical contact is disconnected, and that the electrical contact is restored immediately upon re-insertion of dust container 12.

Alternatively or in addition to being activated during the vacuuming operation, light source 40 and the electrochromic material may also be activated when vacuum cleaner 10 is not in use. This eliminates the need for the user to start vacuum cleaner 10 when he or she only wants to check the filling level of dust container 12. To this end, vacuum cleaner 10 may, for example, include an additional switch-operating button (not shown in FIG. 4; see control element 28 in FIG. 3) which activates only the electrochromic material of dust container 12 and the illumination provided by light source 40. Vacuum cleaner control system 20 may also be designed such that the illumination and the electrochromic material are automatically activated for a predetermined period of time after completion of the vacuuming operation, so that the user can then decide whether dust container 12 needs to be emptied. Furthermore, vacuum cleaner control system 20 may be designed such that the electrochromic material and the illumination are activated only at predetermined or predeterminable points in time for predetermined or predeterminable periods of time. It is also conceivable to combine the above-mentioned options for activating the illumination.

Figure 5:
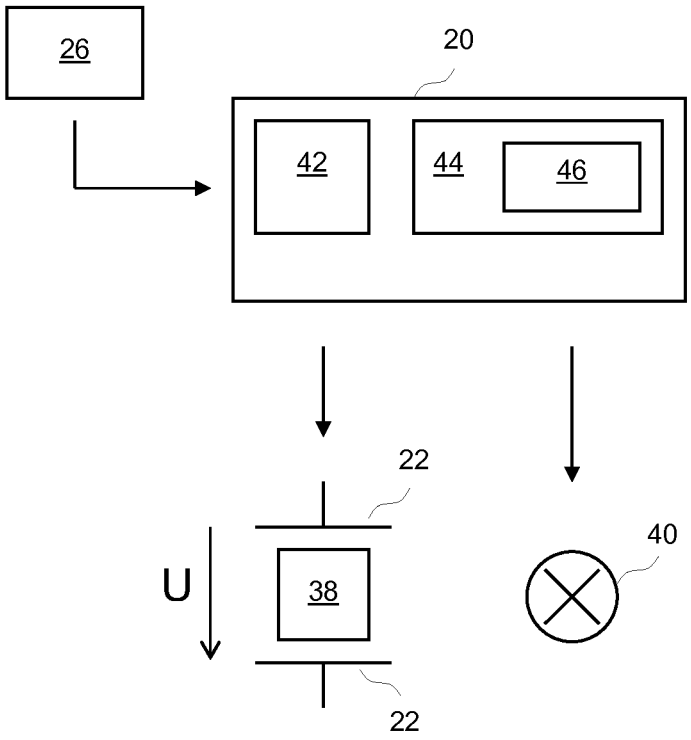
FIG. 5 shows an exemplary embodiment of a vacuum cleaner control system.

FIG. 5 shows, in simplified schematic form, a possible embodiment of a vacuum cleaner control system 20 for vacuum cleaner 10. The vacuum cleaner control system 20 shown here can be controlled via ON/OFF switch 26 of the vacuum cleaner 10 of FIG. 3 or ON/OFF switch 26 or control element 28 of the vacuum cleaner 10 of FIG. 2. Vacuum cleaner control system 20 includes a microprocessor 42 and a memory 44 having a control program 46 loaded therein. Light source 40 and/or viewing window 38, which is made from or coated with an electrochromic material, may be controlled by vacuum cleaner control system 20 in response to an actuation of ON/OFF switch 26 or control element 28 and/or as a function of points in time and periods of time defined in and retrievable from control program 46.

If the illumination of the interior of dust container 12 is combined with controlling the transparency of dust container 12, vacuum cleaner control system 20 may provide the illumination simultaneously or in predetermined or predeterminable temporal correlation with the activation of the electrochromic material. Furthermore, additionally or alternatively, the voltage supplied to light source 40 and/or the voltage supplied for activating the electrochromic material may be dimmed up and/or down.

Figure 6:
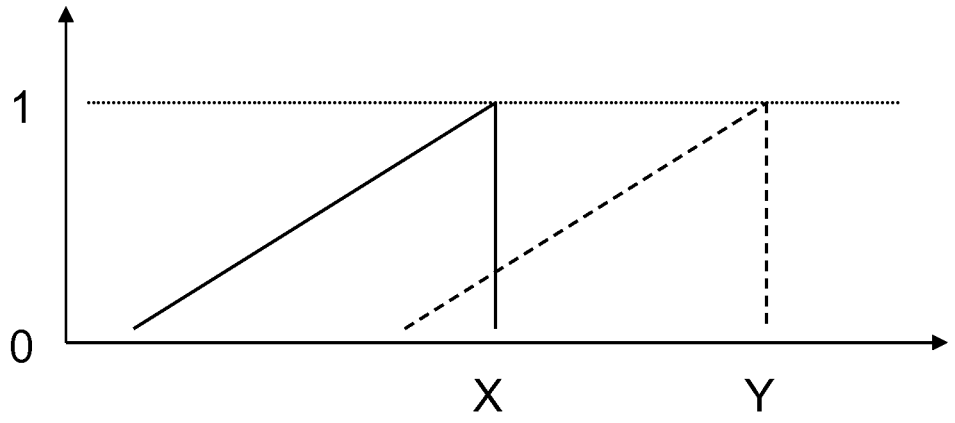
FIG. 6 illustrates an example of a possible temporal correlation between a dimming-up of a voltage supplied to a light source for illuminating an interior of the dust container and of a voltage supplied to an electrochromic material of the dust container.

FIG. 6 illustrates, by way of example, a temporal correlation between a dimming-up of a voltage supplied to an electrochromic material of dust container 12 (solid line) and a dimming-up of a voltage supplied for illuminating the interior of dust container 12 (dashed line). The time is plotted on the abscissa. The ordinate illustrates voltage supply levels for the electrochromic material and for the illumination. At "0", no voltage is applied to the electrochromic material and the illumination is completely off. At instant "X", the voltage supplied to the electrochromic material reaches level "1", at which maximum voltage is applied to the electrochromic material, so that it reaches its maximum transparency. At a later instant "Y", the voltage supplied for the illumination reaches level "1", at which the illumination reaches maximum possible brightness. The dimming-up of the respectively supplied voltages is illustrated as a linear rise over a predetermined period of time between the voltage supply levels. Of course, the increase may also be non-linear, such as, for example, quadratic, exponential or in another suitable form. The turning-on and dimming up of the voltage supplied to the electrochromic material (solid line) and the turning-on and dimming up of the voltage supplied for the illumination (dashed line) are separated in time by a predetermined interval specified, for example, in control program 46 (FIG. 5). In the exemplary embodiment shown here, the illumination is not activated until the electrochromic material has become transparent to a certain degree (e.g. 50%). If, as shown in FIG. 6, the dimming-up of the voltage supplied for the illumination and the dimming-up of the voltage supplied to the electrochromic material are performed at the same rate, then the voltage supplied for the illumination is still being dimmed up when the electrochromic material reaches its maximum transparency. The corresponding gradual increase in the brightness of illumination can then be readily perceived by the user. Alternatively, the voltage supplied for the illumination may be dimmed-up more rapidly than the voltage supplied to the electrochromic material, for example, in such a way that both voltages reach level "1" at the same time. For purposes of dimming down the voltage supplied for the illumination and the voltage supplied to the electrochromic material, it would be possible to conceive of a corresponding voltage curve, in which the voltages would continuously decrease from level "1" to level "0".

In order to protect the inner surface of dust container 12 from abrasion by moving dust particles, especially if dust container 12 is made entirely from a chromogenic or electrochromic material, or if such a coating is provided on the inner surface of dust container 12, the chromogenic/electrochromic material is also made scratch-resistant by admixture of additives.

In order to produce a dust container 12 that is controllable in its transparency, chromogenic glasses, in particular electrochromic glasses, may also be used. In such an variant, dust container 12 may have a layered construction, where an electrochromic glass layer is disposed between a scratch-resistant glass body forming the inner surface of dust container 12 and a second, outer glass body having conventional material properties.

In summary, the herein disclosed bagless vacuum cleaner 10 and its dust container 12 which is controllable in its transparency provides a bagless vacuum cleaner 10 that has a high-quality appearance, especially during operation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE NUMERALS

10 bagless vacuum cleaner
12 cyclone, dust container
14 intermediate filter (fine dust filter)
16 exhaust filter
18 fan
20 vacuum cleaner control system
22 electrodes
24 user control
26 ON/OFF switch
28 control element
30 handle
32 charge/operating state indicator
34 suction opening
36 dust check valve
38 viewing window
40 light source
42 microprocessor
44 memory
46 control program

What is claimed is:

1. A bagless vacuum cleaner comprising:

a dust container including a chromogenic material so as to have a controllable transparency, wherein the chromogenic material is an electrochromic material, and wherein the dust container has electrodes for activating the electrochromic material.

2. The bagless vacuum cleaner as recited in claim 1, further comprising an electric circuit for activating the electrochromic material, wherein the dust container is removable from the vacuum cleaner, and the electrodes associated with the dust container are connectable with the electric circuit for activating the electrochromic material during the combining of the dust container with the vacuum cleaner.

3. The bagless vacuum cleaner as recited in claim 2, wherein the vacuum cleaner includes a user control operable to control electric circuit.

4. The bagless vacuum cleaner as recited in claim 3, wherein the user control is disposed on a handle of the vacuum cleaner.

5. The bagless vacuum cleaner as recited in claim 3, wherein the user control includes a switch for controlling the electric circuit.

6. The bagless vacuum cleaner as recited in claim 1, wherein a vacuum cleaner control system is configured to automatically activate the electrochromic material at predetermined or predeterminable points in time for a predetermined or predeterminable period of time.

7. The bagless vacuum cleaner as recited in claim 1, wherein a vacuum cleaner control system is configured to continuously control the transparency of the dust container.

8. The bagless vacuum cleaner as recited in claim 1, wherein a vacuum cleaner control system is configured to at least substantially continuously control the transparency of the dust container.

9. The bagless vacuum cleaner as recited in claim 1, wherein the vacuum cleaner includes at least one light source associated with the dust container that is configured to be activated synchronously with the controlling of the transparency of the dust container.

10. The bagless vacuum cleaner as recited in claim 9, further comprising a dimmer for dimming up or down a voltage supplied to the electrochromic material and a voltage supplied to the at least one light source.

11. The bagless vacuum cleaner as recited in claim 10, wherein there is a predetermined or predeterminable temporal correlation between at least one of the dimming up of the voltage supplied to the electrochromic material and the dimming up of the voltage supplied to the at least one light source, or the dimming down of the voltage supplied to the at least one light source and the dimming down of the voltage supplied to the electrochromic material.

* * * * *